United States Patent [19]

Galimberti

[11] Patent Number: 4,846,349

[45] Date of Patent: Jul. 11, 1989

[54] METHOD AND EQUIPMENT FOR THE PRODUCTION AND PACKAGING OPERATION OF A CONTINUOUS MANUFACTURE OF SMALL BAGS WITH LONGITUDINAL FOLDS AND TRANSVERSAL PRE-INCISIONS AND MANUFACTURE THUS PACKAGED

[76] Inventor: Gianfranco Galimberti, Via Pancaldo No.4, 20129 Milano, Italy

[21] Appl. No.: 140,147

[22] Filed: Dec. 30, 1987

[51] Int. Cl.[4] ..... B65D 85/67

[52] U.S. Cl. ..... 206/390; 206/554; 206/820; 493/194; 493/199

[58] Field of Search ..... 206/390, 554, 494, 820; 493/186, 189, 193–195, 198–200, 203, 205, 208, 227, 231

[56] References Cited

U.S. PATENT DOCUMENTS

| | | | |
|---|---|---|---|
| 4,364,490 | 12/1982 | Lang et al. | 206/390 |
| 4,390,096 | 6/1983 | Goldenberg | 206/390 |
| 4,508,222 | 4/1985 | Choe | 206/390 |
| 4,597,494 | 7/1986 | Benoit | 206/390 |
| 4,655,347 | 4/1987 | Horn | 206/390 |

*Primary Examiner*—Jimmy G. Foster
*Attorney, Agent, or Firm*—McGlew & Tuttle

[57] ABSTRACT

In a method for the production and packaging of a continuous strip of small bags each formed with two longitudinal folds and with transverse welds and transverse pre-incisions, the continuous manufacture is longitudinally folded after the formation of the welds and the pre-incisions defining adjacent single small bags, is die-cut to form the handles and then is wound up as a reel.

7 Claims, 2 Drawing Sheets

METHOD AND EQUIPMENT FOR THE PRODUCTION AND PACKAGING OPERATION OF A CONTINUOUS MANUFACTURE OF SMALL BAGS WITH LONGITUDINAL FOLDS AND TRANSVERSAL PRE-INCISIONS AND MANUFACTURE THUS PACKAGED

DESCRIPTION

The invention is related to the production and operation packaging operation of continuous manufactures for the realization of single small bags so called "shoppers", which are created by a tubular material forming two opposed longitudinal folds when it is flattened and equipped with couples of transversal weldings that flank pre-incisions suitable to allow the separation of the single bag. For the formation of handles on the small bags the central die-cutting is provided with a portion of the material in the vicinity of the weldings and the pre-incision lines, so that two laces or suspenders are formed, which make up the handles suitable for keeping the small bag suspended.

The method according to the invention permits to realize a reel type confection or packaging of the manufacture, which is particularly stable and permits also to realize a very fast and continuous production of the manufacture as far as the die-cutting phase of the portion to be removed for the formation of the small bag with handles is concerned.

Substantially in a method according to the invention, for the production and confection operation of a continuous manufacture of small bags (shoppers) possibly with two longitudinal folds and transversal pre-incisions, the continuous manufacture is folded longitudinally and wound up as a reel; in practice said folding is in a central position.

The central die-cutting that affects the internal portions of the two lateral foldings is carried out after the longitudinal folding on the doubled thickness of the continuous manufacture and in practice can be partially delimited by the transversal pre-incision; at least two incisions slanting with respect to the pre-incision and formed in advance allow the continuity of the die-cutting.

The die-cutting can be also delimited by at least three rectilinear or shaped cuts and by four connection incisions of said cuts, said connection incisions being realized in the zones wherein a reciprocating motion takes place, and preferably before the pre-incision and the welding.

In practice the continuous longitudinal folding is formed with symmetrical foldings of the continuous manufacture produced in a horizontal arrangement, and after said folding the die-cutting of the folded manufacture is carried out.

Equipment to realize in practice the method according to the invention comprises means for the continuous longitudinal folding of the manufacture, and means for the die-cutting of the folded manufacture. The means for the folding are symmetrical in order to fold the manufacture from the horizontal arrangement, while the means for the die-cutting act according to a direction that is transversal with respect to the progress of the folded manufacture.

Moreover the means for the die-cutting, when this is carried out by cuts which are rectilinear transversal and longitudinal with respect to the progress direction of the manufacture, comprise dead center means for the realization of the longitudinal cuts of die-cutting and scissors type means for the transversal cuts.

In a practical embodiment, the scissors type means are placed on a system movable with a reciprocating motion to follow the continuous manufacture being formed during the realization of the transversal cuts of die-cutting. In another practical embodiment, the equipment comprises an accumulation system to carry out the temporary stop of the progress of the continuous manufacture in the zone of the die-cutting, and for the necessary duration thereof.

Substantially by the method in question a possibility of production is obtained, which is very fast and continuous, with a piece by piece die-cuttng, by blanking, of the small bag type manufactures, which are maintained in the continuous conformation in which they are produced to be extemporaneously separated in correspondence to the pre-incision lines. The confection that is packaging operation does not require the grouping of single small bags to form packages or boxes of them, and this allows the maintenance of a velocity of the production and confection operation which is relatively much greater than the velocity in the methods actually known, which foresee the separation of the single small bags. Moreover it is possible to carry out easily a reel confection that remains compact because of the substantial uniformity of the transversal thickness of the manufacture being longitudinally folded.

The invention will be better understood by following the description and the attached drawing, which shows a practical non-limitative exemplification of the invention itself. In the drawing.

Figure 5:
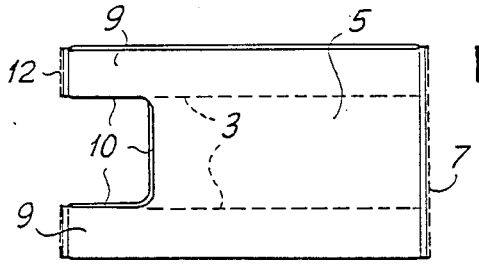
FIG. 5 shows a single small bag separated from the continuous manufacture.

According to what is illustrated in the enclosed drawings, a continuous tubular manufacture 1 is formed in a horizontal posture and with a progress according to arrow f1, which manufacture has a double internal longitudinal folding 3 to form single small bag type manufactures, such as the one illustrated in FIG. 5, with a body 5 obtained from a continuous manufacture folded with folds 3, with a bottom 7 defined by a welding and a cut and with suspender type handles 9 obtained by the effect of a central die-cutting 10 in a zone adjacent to a further welding 12, which closes the suspender type handles 9. Substantially the single small bag type manufactures are obtained through the formation of couples of transversal welding lines 7X and through pre-incision lines 7Y comprised between the adjacent weldings 7X, to separate the single small bags at the time of the use or at time of the confection to make packages.

Figure 1:
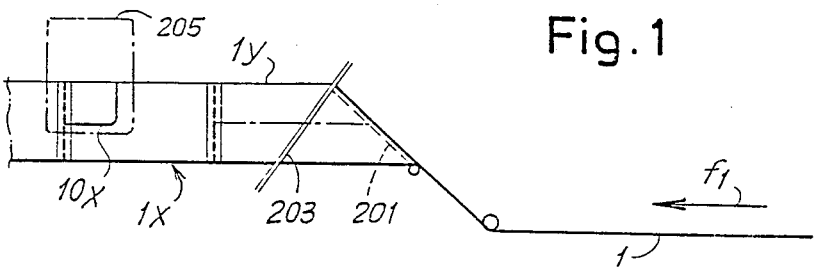
FIGS. 1 and 2 show a side view and a plan view related to the formation of the manufacture.
Figure 3:
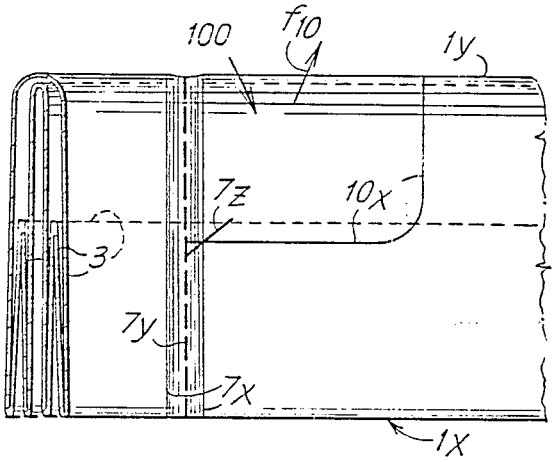
FIGS. 3 and 4 show in an enlarged detail of FIG. 1 and, in a perspective view, the manufacture being longitudinally folded and in correspondence with a die-cutting.
Figure 4:
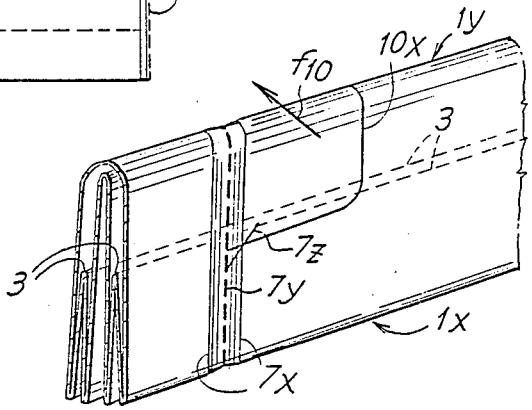

According to the invention, the continuous manufacture, formed by the tubular material 1 with foldings 3, with the couples of transversal weldings 7X and with the pre-incision lines 7Y between the two weldings of each couple of weldings 7X, is longitudinally folded along its proper centerline on 1Y, then it is confectioned in a rolled up condition, and the die-cutting - that is of use for the separation of the material along line 10 to form handles 9—is carried out in a continuous way. As can be seen from the drawing, the continuous manufacture is longitudinally folded so that it is doubled and the folds 3 are brought side by side, as is clearly seen on FIGS. 3 and 4. In this folded arrangement, which is indicated by 1X on FIGS. 1 and 2, the manufacture is fed between two continuous cut and contrast members, respectively indicated by 16 and 18 on FIG. 2, to carry out, in correspondence with the longitudinal folding line 1Y and the incision lines 7Y, cuts to create the removal lines 10, these cuts being indicated by 10X on FIGS. 1, 3 and 4. These cuts 10X are such that they affect even the most internal parts of foldings 3, so that they assure the formation of the suspender type handles 9; moreover said cuts have substantially to reach the pre-incision lines 7Y, in such a way that the waste 100 delimited by the pre-incision lines 7Y and the cut line 10X can be removed, for a removal according to arrow f10. In order to assure that the cut takes place with accuracy and without going over the pre-incision line 7Y (this event could tamper with the adjacent manufacture in the bottom thereof) the preliminary formation—that is before the axial folding of the band or web as described in FIG. 2— of a couple of slanting incisions 7Z can be provided, which slanting incisions, cross the pre-incision line 7Y (afterwards realized) along their own development, even if these incisions are not preferably positioned, with respect to the pre-incision line 7Y.

Figure 6:
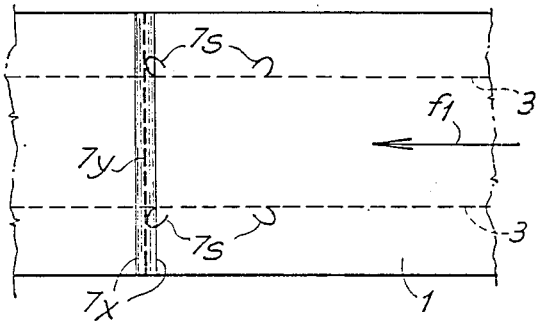
FIGS. 6 and 7 show a plan view of the manufacture and a view thereof in a folded arrangement with an alternative form of incision and die-cutting.
Figure 7:
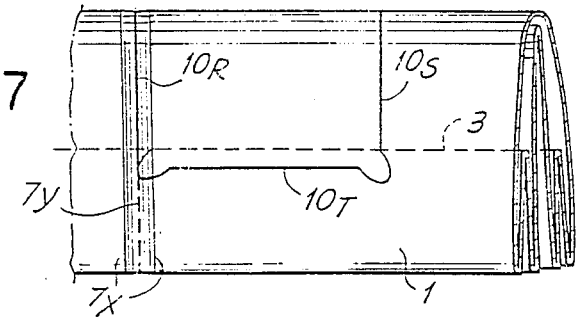

By the die-cutting of the two incisions other incisions like those 7Z can be made, and also incisions with different shape. For example it is possible to carry out in a first stage four U shaped incisions 7S, as illustrated on FIG. 6, which are then of use as connection to three cut lines 10R, 10S, and 10T carried out after the folding of the manufacture, as results from FIG. 7.

The cuts along lines 10R and 10S—to be carried out after the welding and the pre-incison and after the folding—can be operated by a scissors type system, while the cut along line 10T can be made by a lance shaped point. In this case, since the movement of the continuous manufacture is uniform, the cut along 10T can be made by a dead center that is a fixed point. The equipment for the cut along lines 10R and 10S, on the contrary, has to be installed for example on a truck that moves with a reciprocating motion, which has to follow, for the cut duration, the movement of the manufacture. Viceversa, it is also possible to provide a system for accumulation, for example of the rocker lever type, which has to allow—while the motion of the band or web of manufacture remains uniform—a temporary stop of the manufacture section which is interested by the cuts 10R and 10S for the duration of the cutting action.

In the drawing are summarily indicated by numerals 201 and 203 (FIG. 1) means for the longitudinal continuous folding of the manufacture, and by numerals 205 (FIGS. 1 and 2) means for the die-cutting of the longitudinally folded manufacture (1X).

The continuous folded manufacture indicated by 1X is suitably wound up on a reel B, to allow afterwards the unwinding rotation of the reel and the extemporaneous detachment of the single little bags along the pre-incision lines 7Y.

The waste 100 delimited by the incision line 10X, formed by members 16 and 18, by the incisions 7Z and by the pre-incision 7Y, can be removed before the rolling up on the reel, or it can be extemporaneously removed at the time of the taking of a single small bag; in this case, in particular, it can be provided to maintain a limited continuity between the waste 100 and the body of the bag, by making discontinuous to a limited degree the incision lines 10X. To make easy the detachment of waste 100, the pre-incisions 7Y along the zone corresponding to waste 100 can be accentuated, just to make easy this removal.

The invention is also related to a continuous manufacture, consisting of a tubular manufacture 1 with possible longitudinal folds 3 and with transversal weldings 7X, transversal pre-incisions 7Y and cuts 7Z, 10X or 10S, 10T, 10R, and longitudinally folded in 10Y.

Figure 2:
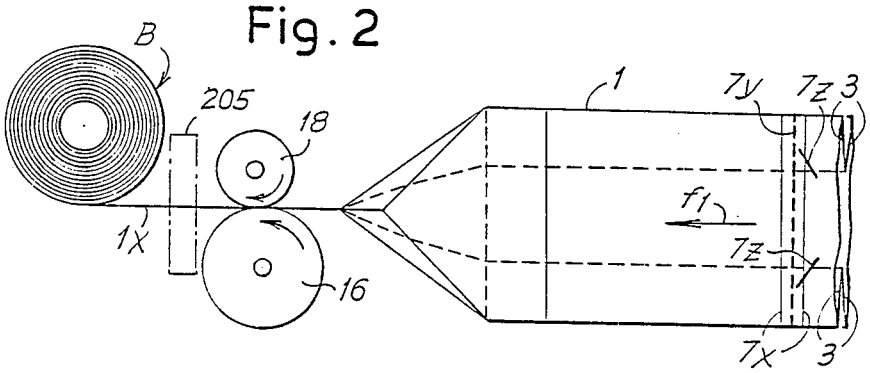

This manufacture can be wound up as a reel, as illustrated in FIG. 2.

It must be understood that the drawing shows merely an exemplification, given only as a practical demonstration of the invention, as the invention can vary in its forms and dispositions, without departing from the scope of the same invention.

I claim:

1. A reeled strip of bags removably attached together in top to bottom relation comprising a continuous tube or flexible material collapsed in flat condition providing opposite major sides bounded by a pair of longitudinal edges with folds of material located between the opposite faces spaced inwardly of and parallel to respective of said longitudinal edges;

pairs of welds extending transversely across the tube defining adjacent top and bottom ends of successive bags;

a frangible portion provided by a line of perforations extending transversely across the tube between the welds of each pair;

the collapsed tube being folded about a medial longitudinal fold line so that the internal folds are in side by side relation;

a cut extending completely through the collapsed tube with a portion of the cut located adjacent and spaced from the top end of each bag to extend transversely of the strip from the internal folds through the longitudinal fold, and another portion of the cut extending longitudinally of the strip towards the top end through the internal folds to the line of perforations, thereby to isolate three removable panels, the first panel comprising material extending from opposite major sides of the bag across the top end of the bag and the second and third panels comprising material extending through respective internal folds, which panels are removable from the strip, thereby to define a mouth and handles on respective opposite lateral sides of the mouth at the top end of the bag when separated from the strip and unfolded.

2. A reeled strip of bags according to claim 1 in which severances intersect obliquely the frangible portion and the longitudinally extending portion of the die cut at the top end of each bag.

3. A reeled strip of bags according to claim 1 in which the longitudinally and transversely extending cut portions intersect four U-shaped cuts extending through the opposite major sides and internal folds of the collapsed tube, the U-shaped cuts being arranged at corners of a quadrilateral, two of such U-shaped cuts intersecting the line of perforations.

4. A method of making a reeled strip of bags removably attached together in top to bottom relation comprising the steps of:

collapsing continuous a tube of flexible material into a flat condition with opposite major sides bounded by a pair of longitudinal edges and with folds of material located between the opposite major sides spaced inwardly of and parallel to respective of said longitudinal edges;

forming pairs of welds transversely across the collapsed tube defining adjacent top and bottom ends of successive bags;

perforating the collapsed tube between the welds of each pair to provide a frangible line portion;

folding the collapsed tube about a medial longitudinal fold line bringing the internal folds into side by side relation;

cutting completely through the collapsed tube at a location adjacent and spaced from the top end of each bag, transversely of the strip through and between the internal folds and longitudinally of the strip towards the top end through the internal folds to the line of perforations, thereby to isolate three removable panels, the first panel comprising material extending across the top end of the bag into opposite major sides of the bag and the second and third panels comprising material extending through respective internal folds, which panels are removable from the strip, thereby to define a mouth and handles on respective opposite lateral sides of the mouth at the top end of the bag when separated from the strip and unfolded.

5. A method of making a reeled strip of bags according to claim 4 including the step of forming severances to intersect obliquely the frangible line portion and the longitudinally extending portion of the cut at the top end of each bag.

6. A method of making a reeled strip of bags according to claim 4 including the step of cutting U-shaped cuts through the opposite major sides and internal folds of the collapsed tube, the U-shaped cuts arranged to intersect the longitudinally and transversely extending cut portions, two of such U-shaped cuts intersecting the line of perforations.

7. A method of making a reeled strip of bags according to claim 4 in which the cutting step is performed after the step of folding the collapsed tube along the longitudinal fold line, the cut being made through the fold.

* * * * *